US009228307B2

(12) United States Patent
Dixit

(10) Patent No.: US 9,228,307 B2
(45) Date of Patent: Jan. 5, 2016

(54) MONOPOD MOUNTED SOLID PET WASTE COLLECTING AND DISPOSING SYSTEM

(71) Applicant: Abhay Dixit, Sherwood Park (CA)

(72) Inventor: Abhay Dixit, Sherwood Park (CA)

( * ) Notice: Subject to any disclaimer, the term of this patent is extended or adjusted under 35 U.S.C. 154(b) by 0 days.

(21) Appl. No.: 14/480,637

(22) Filed: Sep. 9, 2014

(65) Prior Publication Data

US 2015/0102618 A1 Apr. 16, 2015

Related U.S. Application Data

(60) Provisional application No. 61/961,411, filed on Oct. 15, 2013.

(51) Int. Cl.
*A01K 29/00* (2006.01)
*E01H 1/12* (2006.01)

(52) U.S. Cl.
CPC ..... *E01H 1/1206* (2013.01); *E01H 2001/128* (2013.01); *E01H 2001/1246* (2013.01); *E01H 2001/1293* (2013.01)

(58) Field of Classification Search
USPC ..... 294/1.3–1.5, 1.52, 176; 15/257.3, 15/257.6; 119/161
See application file for complete search history.

(56) References Cited

U.S. PATENT DOCUMENTS 3,738,697 A * 6/1973 Kahan ..... 294/1.4
3,868,135 A * 2/1975 Magliaro ..... 294/1.5
4,005,892 A * 2/1977 Williams ..... 294/1.4
4,014,584 A * 3/1977 Bau ..... 294/1.4
4,056,278 A * 11/1977 Bau et al. ..... 294/1.4
4,143,899 A * 3/1979 Wetherall et al. ..... 294/50.9
4,194,777 A * 3/1980 Carns ..... 294/1.4
4,240,656 A * 12/1980 Eiffinger ..... 294/1.4
4,247,139 A * 1/1981 Grieb ..... 294/1.4
4,641,873 A * 2/1987 Nurnberger ..... 294/1.4
5,033,781 A * 7/1991 Flood ..... 294/1.4
5,320,393 A * 6/1994 Cortinas ..... 294/1.4
5,344,200 A * 9/1994 Yoshioka ..... A01K 23/005 294/1.5
5,403,050 A * 4/1995 Searing ..... A01K 23/005 294/1.5
5,676,411 A * 10/1997 Kwok ..... A01K 23/005 294/1.5
6,062,618 A * 5/2000 Figueroa ..... E01H 1/1206 294/1.4
6,485,073 B2 * 11/2002 Harrison ..... E01H 1/1206 294/1.4
7,198,310 B1 * 4/2007 Lau ..... A01K 23/005 294/1.5
7,232,165 B2 * 6/2007 Zelon ..... A01K 23/005 294/1.5
7,261,347 B2 * 8/2007 Krieger ..... 294/1.4
8,146,967 B1 * 4/2012 Brown ..... A01K 23/005 294/1.5
8,544,413 B1 * 10/2013 Gnanendran ..... A01K 23/00 119/161
2002/0140240 A1 10/2002 Charette ..... 294/1.5

* cited by examiner

*Primary Examiner* — Paul T Chin
(74) *Attorney, Agent, or Firm* — Kyle R. Satterthwaite; Ryan W. Dupuis; Ade & Company. Inc

(57) ABSTRACT

A monopod mounted solid pet waste collecting and disposing system, is a pole device with a mounted scooper box. When not in use, the scooper box is mounted vertically parallel to the walking stick. When required for pet waste collection, it is deployed horizontally parallel to the ground. The Scooper box has a provision to insert a specially designed disposable case inside the box which has lower lips to protect the surface of scooper box coming in contact with pet waste and side lips that allows the case to be opened or closed in sync with the scooper box. The internal section of the stick also has control systems to deploy the scooper box for pet waste pick-up, to open and close the two compartments of the scooper box to collect the pet waste from ground and to eject the disposable case out of scooper box.

18 Claims, 7 Drawing Sheets

Figure 1.A
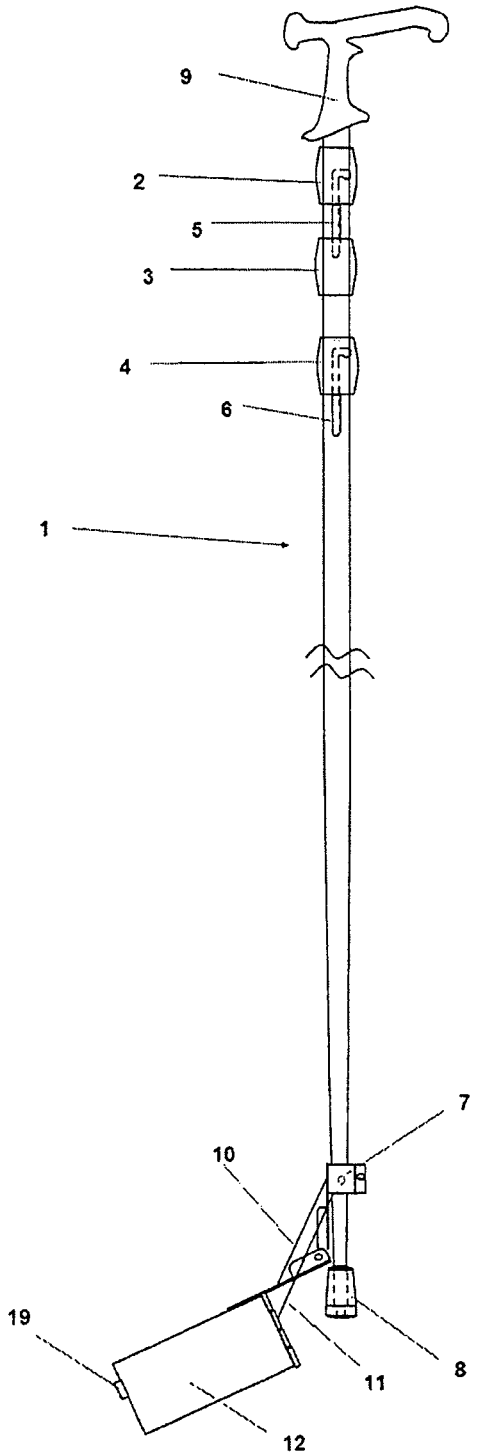

Figure 1.B
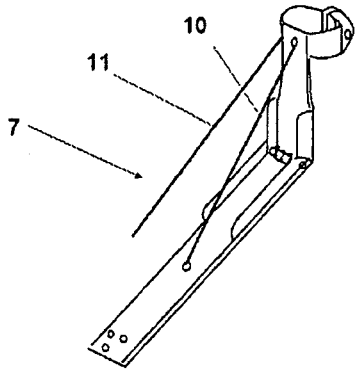
Figure 1.C
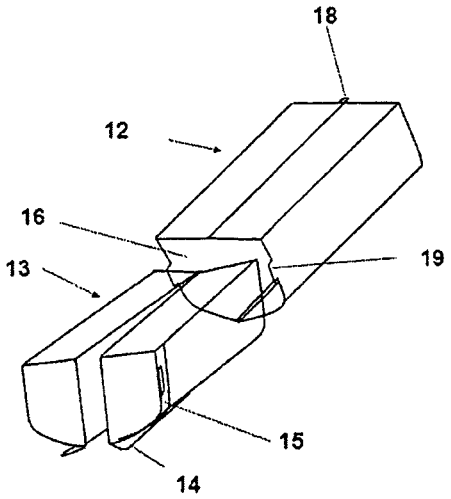
Figure 1.E
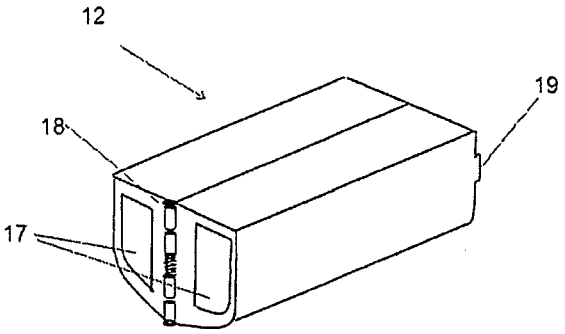
Figure 1.D
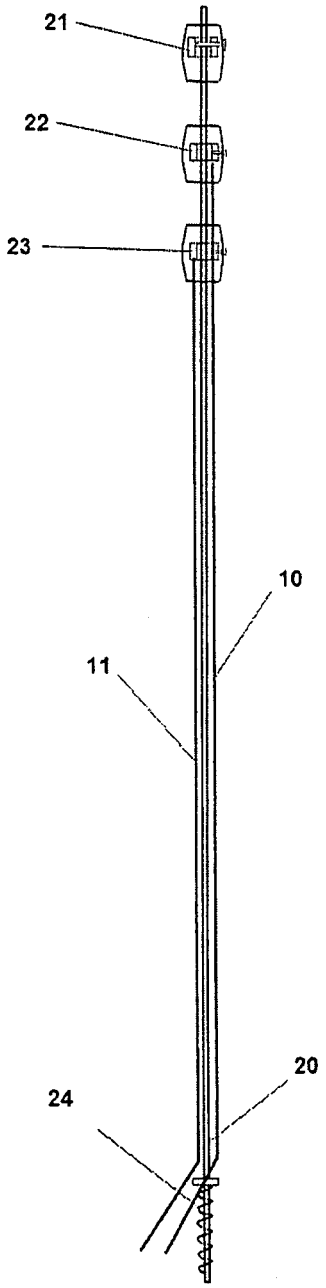

Figure 3.1

Figure 3.2
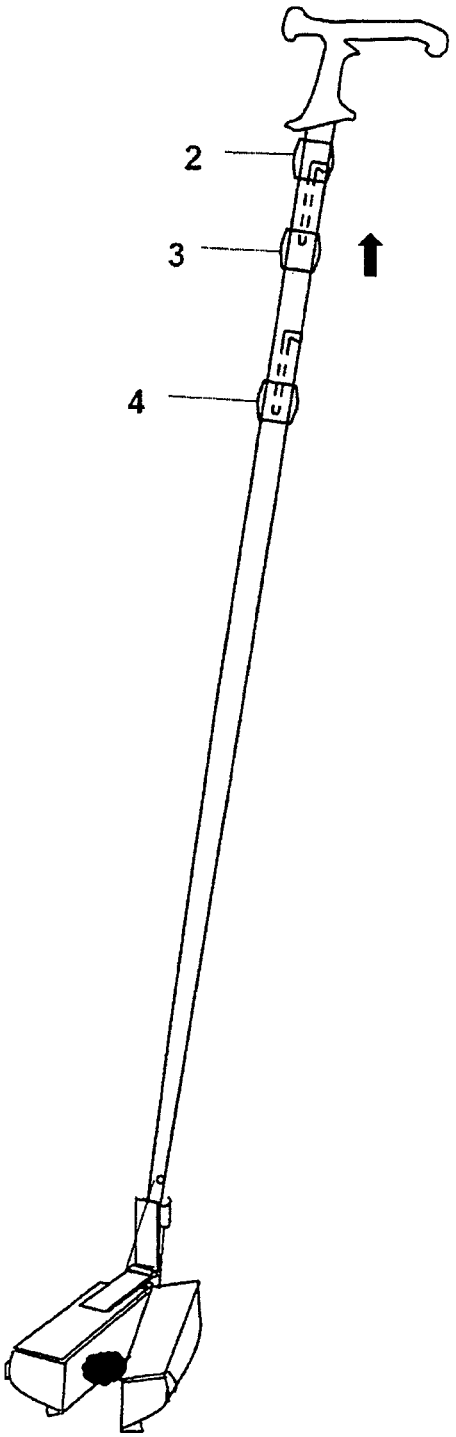
Figure 3.3
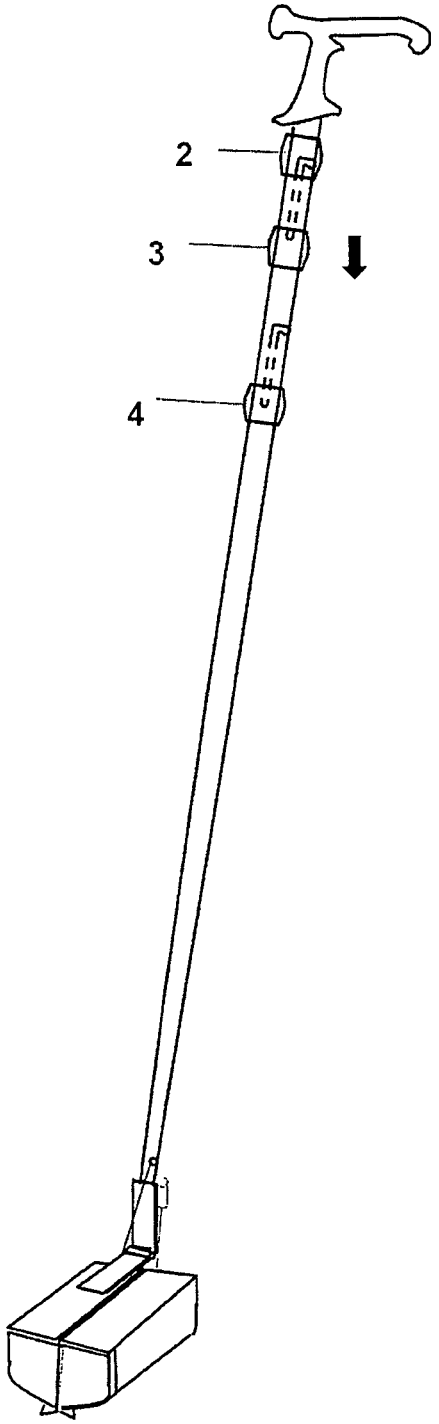

Figure 3.4
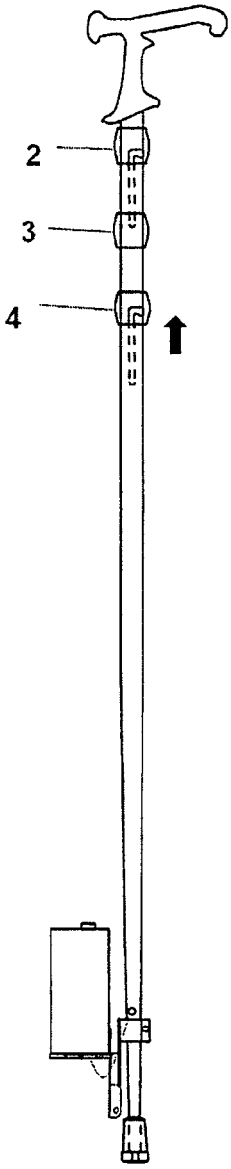
Figure 4.1
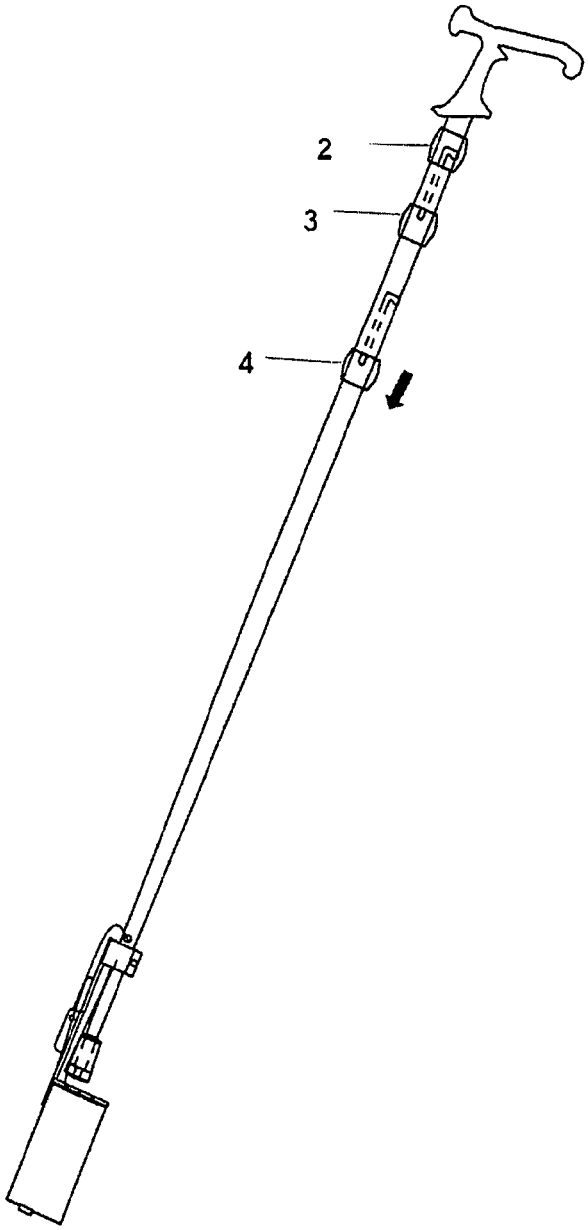

Figure 4.2
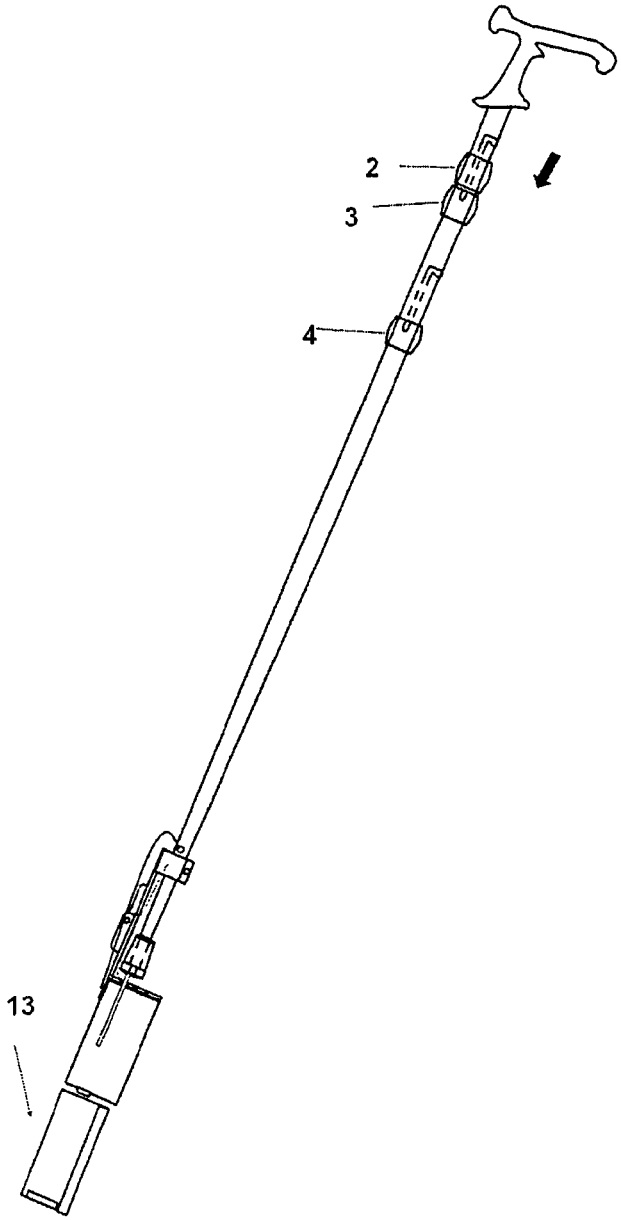
Figure 4.3
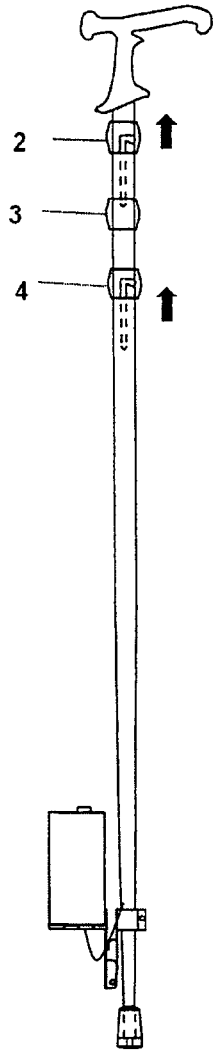

MONOPOD MOUNTED SOLID PET WASTE COLLECTING AND DISPOSING SYSTEM

This application claims the benefit and priority to U.S. provisional application No. 61/961,411 filled on Oct. 15, 2013.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

REFERENCE MATERIAL SUBMITTED ON A COMPACT DISC OR VIA EFS-WEB

Not applicable

BACKGROUND OF THE INVENTION (1) Technical Field

The present investigation is related to a walking stick or other monopod which has an attachment in the form of a pooper scooper device and more specifically a monopod based device to collect and dispose of solid pet waste.

(2) Background Art

According to the 2013-2014 American Pet Products Association Inc. (APPA) National Pet Owners Survey, there are 83.3 million pet dogs in the United States alone. Dogs are very faithful companions and dog walking is a favorite activity among many dog owners. However, there is an obligation while walking a dog; to pick-up the dog wastes from any public place and dispose of it in a proper disposable bin. A good pooper scooper which can be carried during pet walk should be easy to carry, able to pick up solid pet waste without bending and without exposing pet owner to the pet waste, easily and hygienically able to carry after the pet waste has been picked up, allow easy disposal the waste and the device remain clean after their use.

There have been prior attempts to developing a pooper scooper and there are various designs that are patented and commercially available. However, these designs have their own objectives and thus are only useful in limited scope. Known prior inventions for pet waste collection on tubular platform includes; U.S. Pat. No. 5,344,200 issued to Mashayuki Yoshioka, described to insert the casing members inside the tubular body with a pair of casing members to hold a sack.

US20020140240A1 issued to Ernest Charette described for a pair of bag supporting pivoting arms which can be folded. U.S. Pat. No. 8,146,967 issued to Verlon M Brown has a collapsible stalk with a pair of hinged casing members. U.S. Pat. No. 7,232,165 issued to David Zelon, has a nested wand which can be extended by activation of an actuator. It also has a pair of prong unit to hang a disposable bag. U.S. Pat. No. 5,676,411 issued to Wang-On Kwok described for an extension handle with a V shaped resilient support arm and a cylindrical insert to lock the plastic bag. U.S. Pat. No. 5,403,050 issued to Searing et al. described for a bag frame attached at one end of the handle. The bag frame also has an actuator device to close the bag frame. However all these are the dung or animal waste collecting devices with a pair of bag supporting arms that collects the animal waste by directly placing the sack under the rump of the pet animal. These devices cannot be used to collect the pet waste from the ground. Known prior invention to collect the pet waste from the floor and are on tubular platform includes: U.S. Pat. No. 6,062,618 issued to Pedro Figueroa described for an elongated pole with a pair of pivoting arms. A bag is placed on the pivoting arm and scooped by trigger mechanism. U.S. Pat. No. 7,198,310 issued to Ho Yin Lau described for an elongated pole with a pair of pivoting arm at lower segment. U.S. Pat. No. 6,485,073 issued to Jeffrey A Harrison described for a shovel with a disposable bag. These devices fulfill their respective objectives and requirements; however has the limitation that the pet waste remains below the pole. Hence it is not very comfortable to carry to pet waste disposal while pet waste is still in the device.

U.S. Pat. No. 8,544,413 to Abaragidan Gnanendran is a waste bag dispenser for the pet waste and not useful to collect the pet waste from the floor.

The structure, purpose and mechanism of these patents are totally different than the proposed invention. The proposed invention is mainly developed for a pet walk. It is a monopod or walking stick and a hopper shape box attached at lower segment of the stick. It is used to collect the pet/dog waste from the ground and pet waste remains stored in the pooper scooper device and above the walking stick base hence it is easy to carry for the disposal.

SUMMARY OF INVENTION

One aspect of the present invention is a monopod or a stick mounted solid pet waste collecting and disposing system comprising of a stick or other monopod, a pooper scooper box, a disposable case, a spring hinge or pivot, a control assembly to move hinge up and down, a control assembly to open and close pooper scooper box and a control assembly to eject the disposable box out of pooper scooper box.

According to another aspect of the invention, there is provided a solid pet waste collecting and disposing system comprising:

an elongated stick;

a handle carried on the elongated stick at a top of the elongated stick;

a pooper scooper box comprising a pivotally-coupled pair of compartments pivotable relative to one another about a first pivot axis between a closed-together state and an opened state;

a movable connection between the elongated stick and the pooper scooper box by which the pooper scooper box, in entirety, is pivotally movable relative to the elongated stick about a second pivot axis that has a perpendicular relationship to both the first pivot axis and the elongated stick, the movable connection being connected to the elongated stick proximate a lower end thereof and enabling movement of the pooper scooper box between a parked position extending along the elongated stick at a distance spaced above the lower end thereof and a deployed position in which both compartments extend laterally away from the elongated stick below the lower end thereof;

a first control mechanism having a first control input mounted to the elongated stick proximate the top thereof and operably linked to the pooper scooper box to control relative movement of the pivotally-coupled pair of compartments between the closed-together state and the opened state; and a second control mechanism having a second control input mounted to the elongated stick proximate the top thereof and operably linked to the movable connection to control movement of the pooper scooper box between the parked position and the deployed position;

wherein the perpendicular relationship between the first and second pivot axes results opening and closing of the pooper scooper box in a lateral direction transverse to the elongated stick.

In the disclosed embodiment, the pivotally-coupled pair of compartments are spring loaded toward the closed-together state.

The disclosed embodiment includes a disposable case, wherein the pooper scooper box comprises an open face through which the disposable case is removably insertable into the pooper scooper box In the disclosed embodiment, the open face of the pooper scooper box is located at an end thereof that faces upwardly toward the top of the elongated stick in the parked position.

The disclosed embodiment includes a telescopic rod disposed within the stick and moveable between an extended position extending through the lower end of the elongated stick and a retracted position upwardly withdrawn from the lower end of the elongated stick, wherein the pooper scooper box has a window therein that is located opposite the open face and the movable connection is arranged to enable movement of the pooper scooper box past the deployed position into a lowered position residing beneath the lower end of the elongated stick with the window facing toward said lower end of the elongated stick, whereby movement of the telescopic rod into the extended position with the pooper scooper box in the lowered position forces the disposable case downwardly out of the pooper scooper box through the open face thereof.

The disclosed embodiment includes comprising a third control mechanism having a third control input mounted to the elongated stick proximate the top thereof and operably linked to the telescopic rod to control movement thereof between the extended and retracted positions.

In the disclosed embodiment, the telescopic rod is spring loaded toward the retracted position.

In the disclosed embodiment, the third control input and the first control input are slidably engaged in a same channel in the elongated walking stick with the third control input disposed above the first control input of said same channel, and the first and third control mechanisms are arranged such that upward movement of the first control input opens the pivotally-coupled compartments of the pooper scooper box and downward movement of the third control input extends the telescopic rod.

In the disclosed embodiment, the first control mechanism comprises a flexible pulling medium that runs internally down the elongated stick from the first control input, exits the elongated stick at a location further downward thereon and joins to one of the pivotally-coupled compartments to open said one of the pivotally-coupled compartments away from the other of said pivotally-coupled compartments under raising of the first control input along the elongated stick.

In the disclosed embodiment, the second control mechanism comprises a second flexible pulling medium that runs internally down the elongated stick from the second control input, exits the elongated stick at a point further downward thereon and joins to the movable connection to raise the pooper scooper box toward the parked position under raising of the second control input along the elongated stick.

In one embodiment, each flexible pulling medium comprises wire.

In the disclosed embodiment, the second control input is slidably engaged with a respective channel in the walking stick for upward and downward sliding of said second control input along the elongated stick within said respective channel to operate the second control mechanism, and said respective channel comprises a horizontal extension in which the second control input is engagable to lock the pooper scooper box in the parked position.

In the disclosed embodiment, the movable connection is spring-loaded and forces the pooper scooper box away from the parked position.

In the disclosed embodiment, the disposable case comprises a lower lip arranged to cover a bottom edge of the pooper scooper box at the open face thereof to protect said bottom edge from contact with pet waste during collection thereof in the pooper scooper box.

In the disclosed embodiment, the pooper scooper box comprises extension tips jutting from respective edges on the pivotally-coupled compartments of the pooper scooper box at the open face thereof, and the disposable case comprises side lips arranged wrap around the edges of the pooper scooper box at the open face thereof and openings positioned in the side lips to receive the extension tips of the pooper scooper box when the disposable case is inserted in the pooper scooper box, whereby with the extension tips received in the openings, movement of the pivotally coupled compartments into the opened state will automatically open the disposable case.

The proposed invention of the monopod mounted solid pet waste collecting and disposing system has several unique features which were previously not anticipated or used in any of the previous invention. It also has many novel features that provided functional improvement in previous design. Some of the distinguish features of the proposed invention are:

a. Pet waste is picked up and disposed of in the bin with the help of the control knobs installed in the upper segment of the walking stick hence it doesn't require the user to bend over.

b. It has a distinctively shaped disposable case with an extension edge. This extension covers the bottom edges of the scooper box so the box surface remains free from coming in contact with the pet waste. Hence pet waste never comes in contact with the scooper box and it remain hygienic and clean to store and carry.

c. Once pet waste is collected it remains in the pooper scooper box attached at the bottom of the stick hence it can be easily and gracefully carried to the disposal-bin.

d. The pet waste is discarded by ejecting the disposable case with the retractable pipe which is operated by a control knob at upper segment of the stick. The whole operation of pet waste pick-up, carrying and disposal is implemented hygienically without coming in close contact with the user.

BRIEF DESCRIPTION OF THE DRAWINGS

FIG. 1.A describes the parts of the main body; FIG. 1.B illustrates the body shape and major components of the spring hinge; FIG. 1.C and FIG. 1E illustrates the body shape and major components of the disposable case and the pooper scooper box; FIG. 1.D describes the control mechanism to operate the pooper scooper function and spring to inject the disposable box out of the pooper scooper box. FIGS. 2, 3.1, 3.2, 3.3, 3.4, 4.1, 4.2 and 4.3 describe the device at various functional modes.

Figure 1:
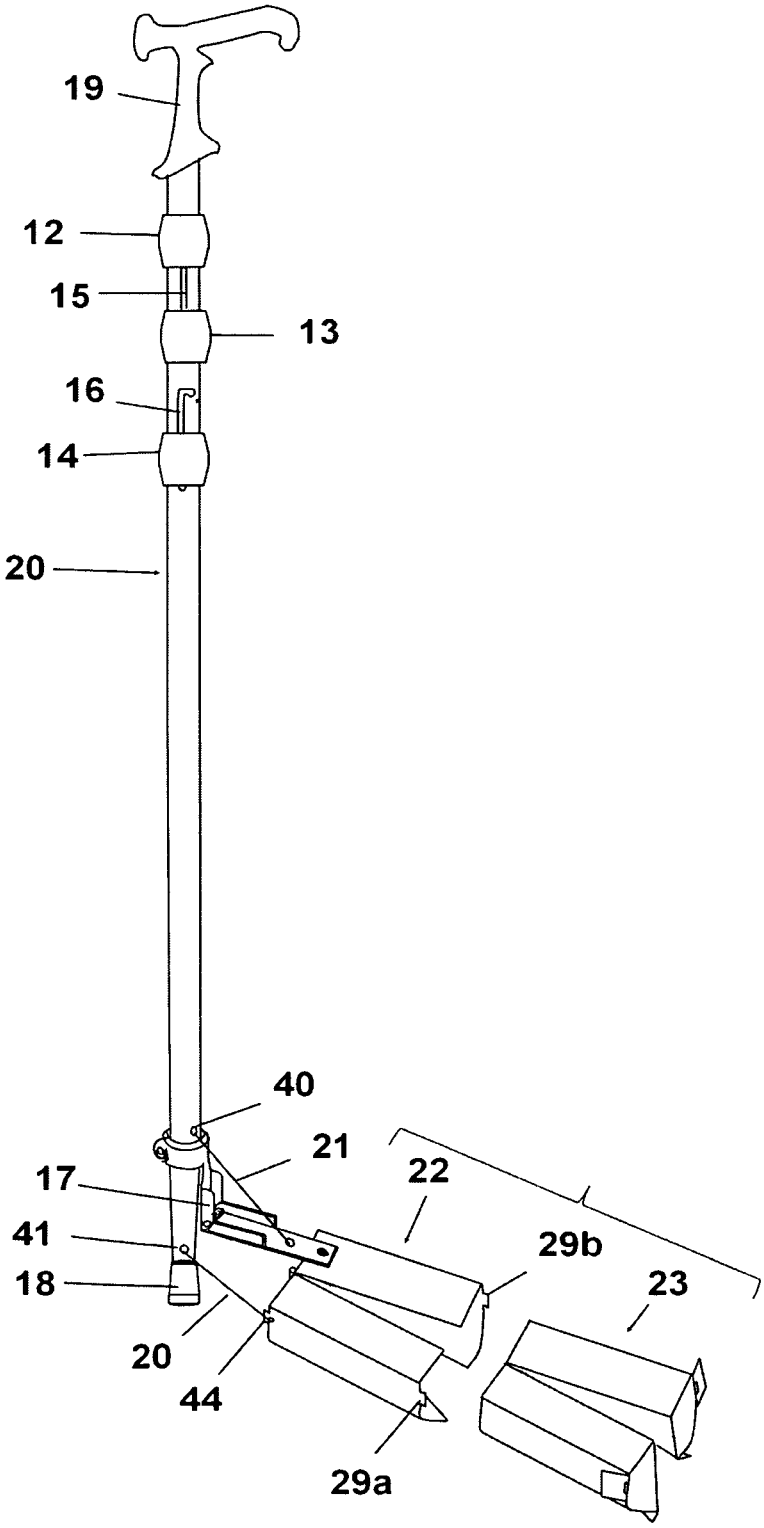
FIG. 1 illustrate the major components of the present invention.

All parts as illustrated in the above figure can be identified with their following sequential number:

1. Stick (Monopod)

2. Top control knob (Eject the retractable probe to release the disposable)

3. Middle Control knob (To; open & close the box)
4. Lower Control knob (To; up & down the box).
5. Channel for the Upper Control Switch.
6. Channel for the Lower Control Switch
7. Spring hinge (To move the pooper scooper box up and down)
8. Stick foot
9. Handle
10. Tie-in wire between Upper Control switch & Pooper Scooper Box compartment (to open & close)
11. Tie-in wire between Lower Control switch & spring hinge (to move up & down)
12. Pooper scooper box
13. Disposable case
14. Lower Lip of the Disposable case
15. Outer Lip of the Disposable case
16. Open-end of the Pooper scooper Box
17. Window opening at back of the pooper scooper box
18. Box Hinge (to swing the box compartments)
19. Extension in the pooper scooper box to hold the disposable case
20. Telescopic or retractable rod
21. Top Control Switch (Connecting top switch and retractable rod).
22. Middle Control Switch
23. Lower control switch
24. Compression spring Stick (Monopod)

FIGS. 1.A, 1.B, 1.C, 1.D and 1.E describes the main elements of the preferred embodiment. As illustrated in the figure, the proposed invention is comprised with a stick 1, in the form of a walking stick with a pooper scooper box 12 attached at lower side of the stick. The pooper scooper box has provision to place a disposable box 13 inside the box. A hollow foot 8 at the bottom of the stick 1 and a handle 9 at top is also attached with the stick 1. A telescopic or retractable rod 20 is placed inside the stick 1, where it remains above the hollow foot 8 with the help of a compression spring 24. Upper portion of the stick 1 has three control knobs; Upper control knob 2 is attached with the telescopic rod 20 via an Upper control switch 21. The middle control knob 3 is linked with the middle control switch 22 and bottom control knob 4 is linked with a bottom control switch 23. These three knobs slide up and down in two vertical channels cut in the stick. The upper control knob 2 and Middle control knob 3 slides in the upper channel 5 and lower control knob 4 slides in the lower channel 6. The top of the each vertical cut has a small horizontal extension which provides locking mechanism for the upper and lower control switch 2 and 4 respectively. The upper control switch 21 is attached with the telescopic rod 20, when the upper control switch 2 is pushed downwards; it partially releases the telescopic rod 20 out from the hollow foot 8. The middle control switch 3 and lower control switches 4 are attached with the pooper scooper box 12 via two tie inn wires 10 and 11.

The pooper scooper box 12 is in the form of two compartment box or cage. Both compartments are linked with each other by a spring loaded hinge 18 forcing the both compartments in closed position. One side of the box is fully open 16 and its opposite side has a window opening 17. The Pooper scooper box 12 is attached to the skid 1 via a spring loaded hinge 7 which opens from 0 to 180 degree. Hinge 7 is spring loaded forcing the pooper scooper box 12 downwards. One side of the hinge 7 is attached with the skid 1 and other side of the hinge 7 is attached to a segment of the pooper scooper box 12. The hinge 7 is attached at top of the pooper scooper box 12 so when it is open to 180 degree, it bring box 12 under the foot 8 so the disposable case 13 can be ejected out by pushing the top control knob 2. In normal parked position the open side of the pooper scooper box 16 is always facing up. Disposable case 13 is top down inserted from this opening 16. The window opening at opposite side of the box 17 is utilized to eject the disposable case 13 by pushing the telescopic rod 20.

Middle control knob 3 is linked with one of the compartment of the pooper scooper box 12 via a tie-in wire 10. Pooper scooper box 12 is open when tie-in wire 10 is pulled by pulling the middle control knob 3 upwards. Similarly Lower control knob 4 is linked with the spring hinge 7 via tie-in wire 11 in such a way that it pulls the pooper scooper box 12 upwards, parallel to the skid 1.

Disposable case 23 is of similar shape of the scooper box except it is closed from all the four sides. The bottom edge of the disposable case 23 is folded, as shown in FIG. 1.C as Lower lip of the disposable case 14 so it covers the bottom edge of the box. This will protect the box from coming in contact with the pet waste. An outer lip of the disposable case has a vertical cut. When the disposable case 23 is inserted in the pooper scooper box 22, the extension tip of the box 19 is inserted in the vertical cut of the outer lip, so when the box 22 opens; the disposable case 23 also opens along with it.

Figure 2:
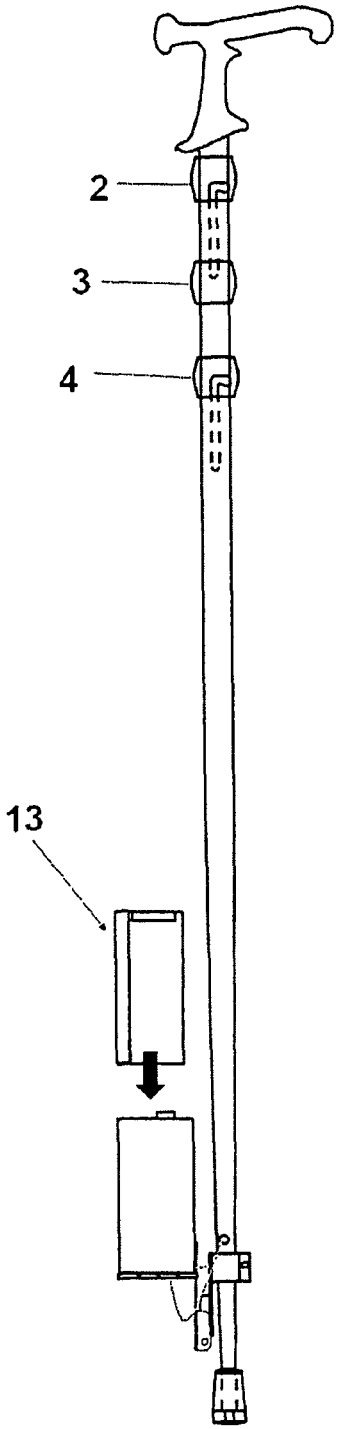
Figure 2:
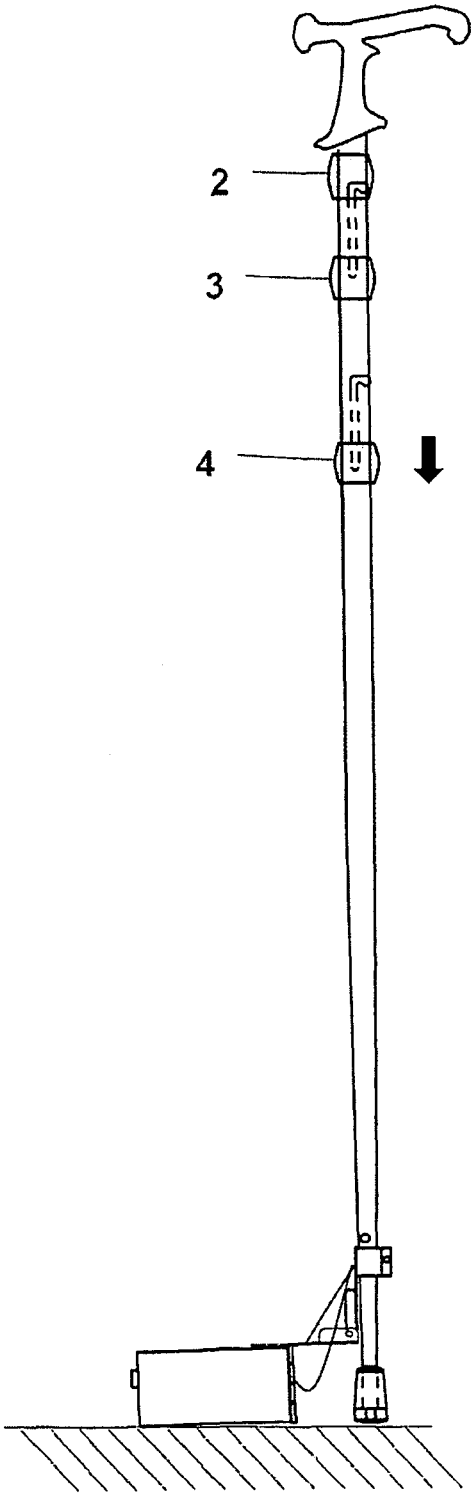

FIGS. 2, 3.1, 3.2, 3.3, 3.4, 4.1, 4.2 and 4.3 describes the status of the proposed device at various functional modes.

Referring to the FIG. 2 the proposed device is in normal carrying and walking mode. At this stage, the stick 1 is used for its normal function to support the walking or can be carried by hand. The top control knob 2 is at upper locked position of the upper channel 5, keeping the retractable rod 20 inside of the stick. The middle control switch 3 is in downward position in the same channel 5, keeping the tie-inn wire 10 at relaxed position. In this state both compartments of the pooper scooper box 12 remains in closed position. The lower control switch 4 is pulled-up and locked in the lower channel 6, forcing the scooper box 12 to vertically upward and parallel to the stick 1. Its open-end 16 is at top position and the disposable case is inserted in it at top down position. During inserting, the Lower lip of the disposable case 14 remains outside covering the bottom edge of the pooper scooper box 5 and the Outer lip of the disposable case 15 wrap around the scooper box; the extended part of the disposable box 19 is inserted in the vertical hole of the side lip of the disposable case 15.

The vertically upward position of the scooper box 12 is providing almost no interference and stick 1 can be used for its normal walking support.

When the device is used for the waste pick-up function, the first action is to unlock and release the lower control Knob 4. It releases the Lower Tie-in wire 11 and spring loaded Hinge 7 forces the scooper box downwards. The scooper box 12 is supported against the ground maintaining it horizontally parallel to the ground. The above status is shown in the FIG. 3.1.

To pick-up the dog/pet waste, the scooper box 12 is opened by pulling the Middle Control switch 3, which in fact is connected with the pooper scooper box 12 via tie-in wire 10. The sides lip of the disposable case 15 forces the disposable case 13 to open along with the scooper box 12. The open scooper box 12 is glided around dog/pet waste in such a way the waste remains between both the compartments. The action is described in FIG. 3.2. At this position, the Middle control switch 3 is released to close the scooper box 12, forcing waste inside the disposable case. This action is as shown in FIG. 3.3.

The device can be brought to the normal walking stick mode similar to FIG. 3.4. In this step, the Pooper scooper box 12 is pulled upward by pulling and locking the Lower control knob 4. This action pulled the tie-in wire 11 which pulled the spring hinge 7 and pooper scooper box 12 to upward position. The pet waste remains inside the disposal case and the stick is ready to carry to dispose in the garbage bin.

To release the disposal case in to the garbage bin, the Pooper scooper box 12 is lowered down by releasing the lower control switch 4. As the skid is not sitting against the floor, it opens ~180 degree. In this status, the Scooper box 12 is vertically underneath of the foot 8 and its open side is in the downward position. This action is described in FIG. 4.1. In next action the disposable case 13 is released by gravity as well as by unlocking and pushing the Upper control knob 2 downwards. The upper control knob 2 is connected with the telescopic rod 20 via upper control switch 21, hence this action forces the telescopic rod 20 against the compression spring 24 and the rod is released underneath the foot 8, which enters through the pooper scooper box window 17 and forces the disposable case 13 out of the pooper scooper box 12. The device position is similar as shown in the FIG. 4.2.

After releasing the disposable case, the device is brought back to walking mode with two actions. In first action, the upper control knob 2 is released allowing the compression spring 24 is pulled back the telescopic rod 20 inside the stick 1 and thereafter, the lower control knob 4 is pulled up and locked. This action is similar to the FIG. 3.4 in which, the tie-in wire 11 pulled the spring hinge 7 and pooper scooper box 12 to an upward position. With this action, the device is back to the walking mode as shown in the FIG. 4.3.

The invention claimed is:

1. A solid pet waste collecting and disposing system comprising:

an elongated stick;

a handle carried on the elongated stick at a top of the elongated stick;

a pooper scooper box comprising a pivotally-coupled pair of compartments pivotable relative to one another about a first pivot axis between a closed-together state and an opened state;

a movable connection between the elongated stick and the pooper scooper box by which the pooper scooper box, in entirety, is pivotally movable relative to the elongated stick about a second pivot axis that has a perpendicular relationship to both the first pivot axis and the elongated stick, the movable connection being connected to the elongated stick proximate a lower end thereof and enabling movement of the pooper scooper box between a parked position extending along the elongated stick at a distance spaced above the lower end thereof and a deployed position in which both compartments extend laterally away from the elongated stick below the lower end thereof;

a first control mechanism having a first control input mounted to the elongated stick proximate the top thereof and operably linked to the pooper scooper box to control relative movement of the pivotally-coupled pair of compartments between the closed-together state and the opened state; and a second control mechanism having a second control input mounted to the elongated stick proximate the top thereof and operably linked to the movable connection to control movement of the pooper scooper box between the parked position and the deployed position;

wherein the perpendicular relationship between the first and second pivot axes results opening and closing of the pooper scooper box in a lateral direction transverse to the elongated stick.

2. The solid pet waste collecting and disposing system of claim 1 wherein the pivotally-coupled pair of compartments are spring loaded toward the closed-together state.

3. The solid pet waste collecting and disposing system of claim 1 further comprising a disposable case, wherein the pooper scooper box comprises an open face through which the disposable case is removably insertable into the pooper scooper box, the open face being located at an end of the pooper scooper box that faces upwardly toward the top of the elongated stick in the parked position.

4. The solid pet waste collecting and disposing system of claim 1 further comprising a disposable case and a telescopic rod, wherein the pooper scooper box comprises an open face through which the disposable case is removably insertable into the pooper scooper box, the telescopic rod is disposed within the stick and moveable between an extended position extending through the lower end of the elongated stick and a retracted position upwardly withdrawn from the lower end of the elongated stick, and the pooper scooper box has a window therein that is located opposite the open face and the movable connection is arranged to enable movement of the pooper scooper box past the deployed position into a lowered position residing beneath the lower end of the elongated stick with the window facing toward said lower end of the elongated stick, whereby movement of the telescopic rod into the extended position with the pooper scooper box in the lowered position forces the disposable case downwardly out of the pooper scooper box through the open face thereof.

5. The solid pet waste collecting and disposing system of claim 4 comprising a third control mechanism having a third control input mounted to the elongated stick proximate the top thereof and operably linked to the telescopic rod to control movement thereof between the extended and retracted positions.

6. The solid pet waste collecting and disposing system of claim 4 wherein the telescopic rod is spring loaded toward the retracted position.

7. The solid pet waste collecting and disposing system of claim 5 wherein the third control input and the first control input are slidably engaged in a same channel in the elongated walking stick with the third control input disposed above the first control input of said same channel, and the first and third control mechanisms are arranged such that upward movement of the first control input opens the pivotally-coupled compartments of the pooper scooper box and downward movement of the third control input extends the telescopic rod.

8. The solid pet waste collecting and disposing system of claim 1 wherein the first control mechanism comprises a flexible pulling medium that runs internally down the elongated stick from the first control input, exits the elongated stick at a location further downward thereon and joins to one of the pivotally-coupled compartments to open said one of the pivotally-coupled compartments away from the other of said pivotally-coupled compartments under raising of the first control input along the elongated stick.

9. The solid pet waste collecting and disposing system of claim 8 wherein the flexible pulling medium comprises wire.

10. The solid pet waste collecting and disposing system of claim 1 wherein the second control mechanism comprises a second pulling medium that runs internally down the elongated stick from the second control input, exits the elongated stick at a point further downward thereon and joins to the movable connection to raise the pooper scooper box toward the parked position under raising of the second control input along the elongated stick.

11. The solid pet waste collecting and disposing system of claim 1 wherein the first and second control mechanisms each comprise a respective flexible pulling medium that runs internally down the elongated stick from the first and second control inputs, exits the elongated stick at a location further downward thereon to join to the pooper scooper and the movable connection so as to respectively achieve the opened state and parked position of the pooper scooper box under raising of the first and second control inputs, respectively, along the elongated stick.

12. The solid pet waste collecting and disposing system of claim 1 wherein the second control input is slidably engaged with a respective channel in the walking stick for upward and downward sliding of said second control input along the elongated stick within said respective channel to operate the second control mechanism, and wherein said respective channel comprises a horizontal extension in which the second control input is engagable to lock the pooper scooper box in the parked position.

13. The solid pet waste collecting and disposing system of claim 1 wherein the movable connection is spring-loaded and forces the pooper scooper box away from the parked position.

14. The solid pet waste collecting and disposing system of claim 13 wherein the second control input is slidably engaged with a respective channel in the walking stick for upward and downward sliding of said second control input along the elongated stick within said respective channel to operate the second control mechanism, and wherein said respective channel comprises a horizontal extension in which the second control input is engagable to lock the pooper scooper box in the parked position.

15. The solid pet waste collecting and disposing system of claim 1 further comprising a disposable case of similar shape to the pooper scooper box, wherein the pooper scooper box comprises an open face through which the disposable case is removably insertable into the pooper scooper box, and the disposable case comprises a lower lip arranged to cover a bottom edge of the pooper scooper box at the open face thereof to protect said bottom edge from contact with pet waste during collection thereof in the pooper scooper box.

16. The solid pet waste collecting and disposing system of claim 1 further comprising a disposable case of similar shape to the pooper scooper box, wherein the pooper scooper box comprises an open face through which the disposable case is removably insertable into the pooper scooper box and extension tips jutting from respective edges on the pivotally-coupled compartments of the pooper scooper box at the open face thereof, and wherein the disposable case comprises side lips arranged wrap around the edges of the pooper scooper box at the open face thereof and openings positioned in the side lips to receive the extension tips of the pooper scooper box when the disposable case is inserted in the pooper scooper box, whereby with the extension tips received in the openings, movement of the pivotally coupled compartments into the opened state will automatically open the disposable case.

17. The solid pet waste collecting and disposing system of claim 3 wherein the pooper scooper box comprises extension tips jutting from respective edges on the pivotally-coupled compartments of the pooper scooper box at the open face thereof, and the disposable case comprises side lips arranged wrap around the edges of the pooper scooper box at the open face thereof and openings positioned in the side lips to receive the extension tips of the pooper scooper box when the disposable case is inserted in the pooper scooper box, whereby with the extension tips received in the openings, movement of the pivotally coupled compartments into the opened state will automatically open the disposable case.

18. The solid pet waste collecting and disposing system of claim 4 wherein the open face of the pooper scooper box is located at an end of the pooper scooper box that faces upwardly toward the top of the elongated stick in the parked position.

* * * * *